United States Patent [19]

Sherman

[11] Patent Number: 4,765,549

[45] Date of Patent: Aug. 23, 1988

[54] TABLET PULVERIZER

[76] Inventor: Renee Sherman, 635 Waukegan Rd., Deerfield, Ill. 60015

[21] Appl. No.: 863,350

[22] Filed: May 15, 1986

[51] Int. Cl.[4] ..... B02C 19/08

[52] U.S. Cl. ..... 241/169; 241/169.2; 241/199.11

[58] Field of Search ..... 241/168, 169, 169.1, 241/169.2, 199.9, 199.11, 261.3

[56] References Cited

U.S. PATENT DOCUMENTS 2,274,250 2/1942 Simpkins ..... 241/168 X 2,726,816 12/1955 Brantley ..... 241/168 X

*Primary Examiner*—Timothy V. Eley

*Attorney, Agent, or Firm*—Niro, Scavone, Haller, Niro & Rocky, Ltd.

[57] ABSTRACT

A hand-operated tablet pulverizer for crushing solid tablets. A tablet container has a closed end forming a pestle and an open mouth at the other end, the closed end having a peripheral thread. A mortar has an internal thread for complementary engagement with the peripheral thread of the container for moving the pestle into engagement with the mortar upon relative rotation thereof in one direction to crush a tablet interposed therebetween. A plurality of protrusions are formed on at least one of the pestle and mortar projecting toward the other, the protrusions being arranged in a pattern of intersecting lines and columns. The protrusions preferably are generally pyramidal in shape, with the bases of the protrusions coincident with those of adjacent protrusions, whereby the protrusions are equally spaced in the respective lines and columns of the pattern thereof.

17 Claims, 2 Drawing Sheets

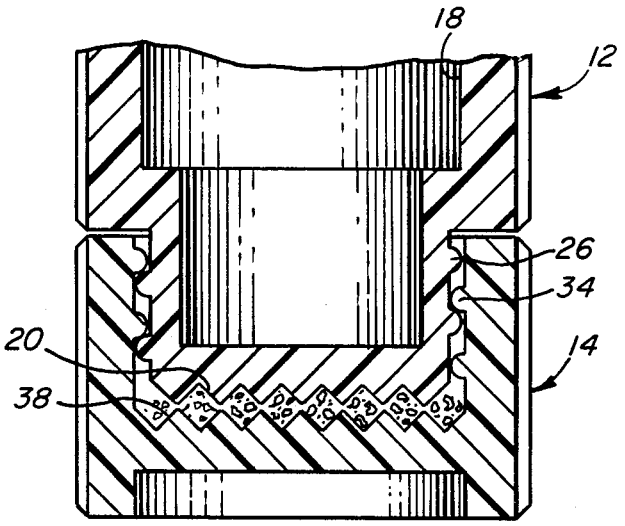
FIG. 4
FIG. 5
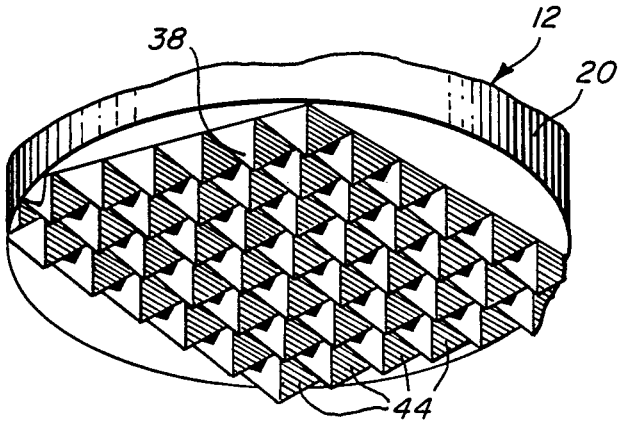

TABLET PULVERIZER

FIELD OF THE INVENTION

This invention relates to improvements in pulverizer and, in particular, to a hand-operated pulverizer used to crush solid materials including medicinal tablets so that they may be easily swallowed by being more completely and readily dissolved in liquid.

BACKGROUND OF THE INVENTION

Individuals often are required to take medication or some form of a tablet, and some individuals have difficulty in swallowing the tablet in whole form. An individual usually must resort to manual crushing of the tablet into particle or powder form. The powdered tablet then is dissolved in liquid which can be more easily swallowed. Some medications actually are manufactured by the tablet maker in liquid or powdered form, but this form of medication usually is not found in most types of medicinal products, partly because of the lack of precise control over dosage. Powdered form medication rarely is packaged in individual dosages, also because of the expense involved. Consequently, most medication is available only in tablet form, and an individual has to resort to crushing or pulverizing the tablet if it cannot be consumed in whole form. This problem not only arises in the realm of human consumption, but other animals, such as horses, are prone to reject medication in tablet form.

Some efforts have been made to provide tablet crushers of the hand-operated or portable type for pulverizing tablets, pills or the like. However, most such efforts result in tablet crushers which do not completely pulverize the tablet into fine particles. They most often crush the tablets simply into smaller pieces unles an exhorbitant amount of time is consumed in operating the devices.

For instance, U.S. Pat. No. 2,602,596 to Jones et al, dated July 8, 1952, shows a tablet crusher which employs opposing convex-concave smooth surfaces for engaging a tablet or tablets therebetween and applying pressure thereto. However, the smooth surfaces often simply compact a tablet in a given location and do not completely pulverize the tablet.

Another example of prior efforts is shown in U.S. Pat. No. 2,726,816 to Brantley, dated Dec. 13, 1955, which forms protrusions and/or indentions in the opposing crushing surfaces to facilitate the breaking and crushing action of the device. However, the protrusions are relatively widely spaced and are arranged in a pattern of generally concentric circles about the axis of rotation of the device. Rather than completely pulverizing a tablet, smaller pieces of the tablet locate themselves between the protrusions and simply ride in and around the protrusions without being pulverized.

Still another example of prior efforts is shown in U.S. Pat. No. 4,366,930 to Trombetti, Jr., dated Jan. 4, 1983. This patent shows a tablet crusher which has opposing, tapered crushing surfaces, with radial grooves in one of the opposing surfaces. However, like Brantley, pieces of the tablets become lodged in the grooves and actually never become completely pulverized.

This invention is directed to a new and improved tablet crushing device which substantially completely pulverizes a tablet or tablets into fine particles with minimal effort and is a considerable improvement over prior devices of the character described above.

SUMMARY OF THE INVENTION

An object, therefore, of the invention is to provide a new and improved hand-operated pulverizer for crushing solid materials into fine particles.

As may be appreciated by those skilled in the art, the pulverizer of the present invention may be utilized with a variety of solid materials, including but not limited to medicinal solid materials such as solid tablets and caplets, solid cooking herbs and spices and similar solids.

In the exemplary embodiment of the invention, a tablet pulverizer is disclosed which includes a tablet container having a closed end forming a pestle and an open mouth at the other end, the closed end having peripheral thread means. A mortar has internal thread means for complementary engagement with the peripheral thread means of the container for moving the pestle into engagement with the mortar upon relative rotation thereof in one direction to crush a tablet interposed therebetween. A plurality of protrusions are formed on at least one of the pestle and mortar projecting toward the other, with the protrusions being arranged in a pattern of intersecting lines and columns to finally crush the tablet in response to relative rotation between the containerpestle and the mortar.

Preferably, the lines of protrusions in the pattern are generally perpendicular to the columns of protrusions. The bases of the protrusions are coincident with those of adjacent protrusions to prevent tablet particles from locating between the protrusions.

The protrusions are illustrated herein in generally pyramidal shapes to define a myriad of points for piercing the tablets to speed up pulverization thereof. The basis of the pyramidal protrusions are coincident with those of adjacent protrusions. The flat sides of the pyramidal protrusions effect movement of the crushed particles during relative rotation of the pestle and mortar.

Lastly, the protrusions are illustrated in a pattern whereby the lines of protrusions are generally parallel and perpendicular to generally parallel columns, with the protrusions in the lines being substantially equally spaced, and the protrusions in the columns being spaced and equal to the spacings of the protrusions in the lines thereof.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 4 is an enlarged, fragmented section illustrating a tablet being pulverized; and FIG. 5 is an enlarged perspective view illustrating the configuration of the pyramidal protrusions.

DETAILED DESCRIPTION OF THE PREFERRED EMBODIMENT

Figure 1:
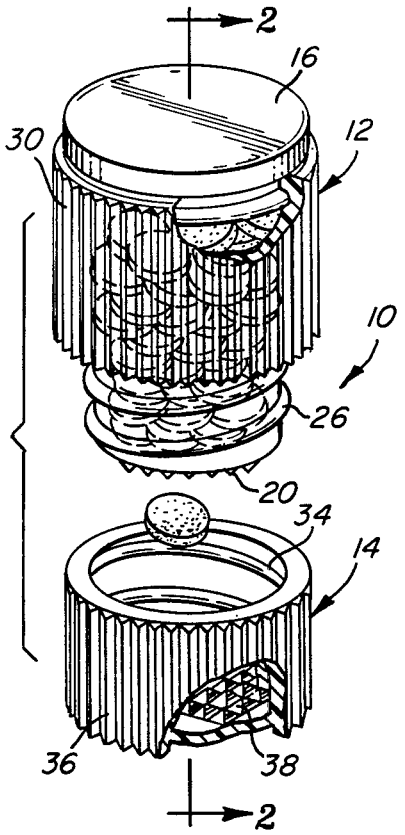
FIG. 1 is a perspective view, partially broken away, of the tablet container and mortar portions of the tablet pulverizer device of the invention.
Figure 2:
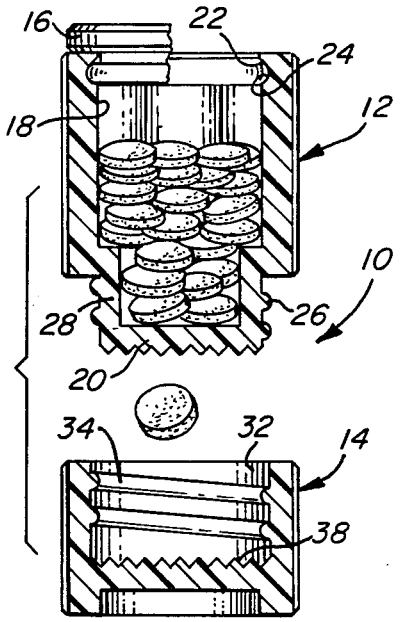
FIG. 2 is a vertical section through the components of the device as shown in FIG. 1.

Referring to the drawings in greater detail, and first to FIGS. 1 and 2, a hand-operated tablet pulverizer is illustrated and generally designated 10, for crushing solid tablets into fine particles. The pulverizing device includes a tablet container, generally designated 12, a mortar, generally designated 14, and a cap 16 for container 12.

The tablet container 12 includes an interior compartment 18 for holding and storing a plurality of tablets or pills. The container has a closed end 20 forming a pestle and an open mouth 22 at the opposite end. Open mouth 22 is provided with an internal groove 24 for receiving cap 16 in a snap-fit manner to retain the tablets in compartment 18. Container 12 further has a peripheral thread 26 about a reduced diameter end portion 28. The outside surface of container 12 is knurled, as at 30 (FIG. 1), to facilitate hand grasping and rotation thereof.

Mortar 14 has an internal cavity or mouth 32 about which is provided an internal thread 34 for complementary engagement with the peripheral thread 26 of container 12. The mortar has an outside diameter which is knurled, as at 36 (FIG. 1) and is of the same diameter as the major outside knurled surface of container 12. In other words, the reduced diameter portion 28 of container 12 threads into mouth 32 of mortar 14. A bottom wall 38 closes the base of mortar 14.

With the above-described structure, with threads 26,34 in engagement, relative rotation of mortar 14 and container 12 in one direction causes the pestle defined by closed end 20 of the container to move toward the bottom wall 38 of mortar 14 to crush a tablet or tablets interposed therebetween, i.e. within mouth 32 of the mortar.

Figure 3:
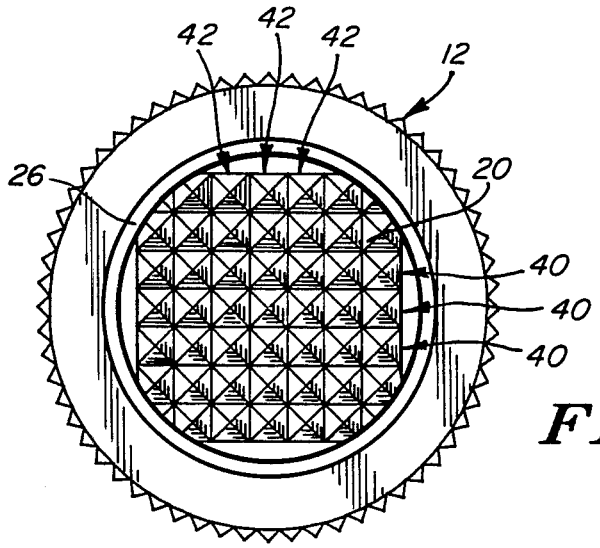
FIG. 3 is a bottom plan view, on an enlarged scale, of the closed end of the tablet container portion, illustrating the pattern of protrusions thereon.

The invention contemplates a novel pattern of protrusions on one or both of the bottom wall 38 of mortar 14 or the pestle formed by closed end 20 of container 12 and projecting toward the other of the pestle or mortar. More particularly, as illustrated in FIG. 3, the protrusions are arranged in a pattern of intersecting lines 40 and columns 42 to provide a grid or network of protrusions completely across the surface or surfaces which engage the tablet. As illustrated herein, the protrusions are located on both the pestle defined by closed end 20 of container 12 and interior wall 38 of mortar 14. However, it should be understood that the protrusions could be formed on only one of the pestle or mortar. Preferably, the lines 40 and columns 42 of projections intersect generally perpendicular to each other, with the bases of adjacent protrusions aligned, as shown in FIG. 3. This prevents tablet particles or pieces from traveling around and between the opposing surfaces without being pulverized, as is prevalent with prior art devices, as will be described hereinafter.

Referring to FIGS. 4 and 5, the protrusions 44 preferably are generally pyramidal in shape to define points for piercing the tablets. Not only does this facilitate immediate crushing of a tablet upon engagement therewith, but the combination of the points (or apexes) of the pyramids and the flat sides of the pyramidal shapes effectively move and facilitate fine crushing of the tablet particles. The flat sides tend to bias the tablet particles radially in response to relative rotation of the components.

FIGS. 4 and 5 also show that the protrusions are formed immediately adjacent or "against" each other, i.e. the bases of the protrusion are coincident with those of adjacent protrusions. This prevents tablet pieces (in comparison with powder) from simply riding around and between the protrusions, without pulverizing, as is prevalent with prior art devices.

In order to further facilitate fine pulverizing of the tablet(s), it is contemplated that the pattern of protrusions on the pestle can be offset or eccentric relative to the pattern of protrusions on the mortar. This would further prevent the tablet particles from simply riding in circular paths between the two components. If the protrusions are formed on one of the mortar or pestle, the pattern can be offset so that neither the apex of a single pyramid or the coincident base between any two adjacent pyramids are located on the axis of relative rotation.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A hand-operated pulverizer for crushing solid materials into fine particles comprising:

a container having a closed end forming a pestle and an open mouth at the other end, the closed end having peripheral thread means:

a mortar having internal thread means for complimentary engagement with the peripheral thread means of the container for moving the pestle into engagement with the mortar upon relative rotation thereof in one direction to crush said solid material interposed therebetween; and a plurality of protrusions on at least one of said pestle and mortar projecting toward the other of the pestle and mortar, each protrusion including a base, the base of each protrusion substantially aligned with those of adjacent protrusions, the protrusions being arranged in a pattern of intersecting lines and columns.

2. The pulverizer of claim 1 wherein said lines of protrusions in said pattern are generally perpendicular to said columns of protrusions.

3. The pulverizer of claim 1 wherein said protrusions are generally pyramidal in shape to define points for piercing the solid material and flat sides for engaging the material particles.

4. The pulverizer of claim 3 wherein the bases of the pyramidal protrusions are coincident with those of adjacent protrusions.

5. The pulverizer of claim 1 wherein the protrusions in the lines thereof are equally spaced.

6. The pulverizer of claim 5 wherein the protrusions in the columns thereof are equally spaced.

7. The pulverizer of claim 6 wherein the protrusions are spaced in said lines thereof equal to the spacing of the protrusions in said columns thereof.

8. The pulverizer of claim 1 including opposing protrusions on both the pestle and mortar.

9. The pulverizer of claim 8 wherein the pattern of protrusions on the pestle is offset relative to the pattern of protrusions on the mortar.

10. A hand-operated tablet pulverizer for crushing solid tablets into fine particles comprising:

a tablet container having a closed end forming a pestle and an open mouth at the other end, the closed end having a peripheral end means;

a mortar having internal thread means for complimentary engagement with the peripheral thread means of the container for moving the pestle into engagement with the mortar upon relative rotation thereof in one direction to crush a tablet interposed therebetween; and a plurality of protrusions on at least one of said pestle and mortar projecting toward the other of the pestle and mortar, the protrusions including a base portion, the protrusions being arranged in a pattern of generally perpendicularly intersecting, generally parallel lines and parallel columns, the protrusions in the lines being substantially equally spaced, and the protrusions in the columns being substantially equally spaced and equal to the spacing of the protrusions in the lines thereof, and the base of one protrusion being substantially aligned with the bases of adjacent protrusions.

11. The tablet pulverizer of claim 10 wherein the bases of said protrusions are coincident with those of adjacent protrusions.

12. The tablet pulverizer of claim 10 wherein said protrusions are generally pyramidal in shape to define points for piercing the tablet and flat sides for engaging tablet particles.

13. The tablet pulverizer of claim 12 wherein the bases of the pyramidal protrusions are coincident with those of adjacent protrusions.

14. The tablet pulverizer of claim 10, including opposing protrusions on both the pestle and mortar.

15. The tablet pulverizer of claim 14 wherein the pattern of protrusions on the pestle is offset relative to the pattern of protrusions on the mortar.

16. The tablet pulverizer of claim 10 wherein said pattern of protrusions is eccentric relative to the axis of relative rotation.

17. A hand-operated pulverizer for crushing solid materials into fine particles, comprising:

a container having a closed end forming a pestle and an open mouth at the other end, the closed end having peripheral thread means;

a mortar having internal thread means for complementary engagement with the peripheral thread means of the container for moving the pestle into engagement with the mortar upon relative rotation of the mortar and pestle with respect to the other of the mortar and pestle about an axis of relative rotation to crush solid material interposed therebetween; and a plurality of protrusions on at least one of said pestle and mortar projecting toward the other of the pestle and mortar, the protrusions being arranged in a pattern of intersecting lines and columns, the pattern being eccentric relative to the axis of relative rotation.

* * * * *